United States Patent [19]

Permenter

[11] Patent Number: 5,038,688

[45] Date of Patent: Aug. 13, 1991

[54] DEVICE FOR HOLDING ARTICLES

[76] Inventor: William F. Permenter, Rte. 1, P.O. Box 1476, LaBelle, Fla. 33935

[21] Appl. No.: 453,574

[22] Filed: Dec. 20, 1989

[51] Int. Cl.[5] ..... E05D 15/02

[52] U.S. Cl. ..... 108/43; 248/444

[58] Field of Search ..... 108/43, 25, 27; 248/444; 350/638

[56] References Cited

U.S. PATENT DOCUMENTS

| | | | |
|---|---|---|---|
| 925,284 | 6/1909 | Buck | 108/43 |
| 1,546,116 | 7/1925 | Bradt | 248/444 |
| 1,770,955 | 7/1930 | Storm | 108/49 |
| 2,647,678 | 8/1953 | Olson | 108/43 |
| 2,663,603 | 12/1953 | Newman | 108/43 |
| 2,979,990 | 4/1961 | Alexander | 108/43 |
| 4,243,249 | 1/1981 | Goss | 108/43 |
| 4,494,754 | 1/1985 | Wagner | 108/43 |
| 4,976,204 | 12/1990 | Konkle | 108/43 |

*Primary Examiner*—Kenneth J. Dorner
*Assistant Examiner*—Gerald A. Anderson
*Attorney, Agent, or Firm*—Alfred E. Wilson

[57] ABSTRACT

A clamping device adapted to be positioned between the legs in the area above the knees is provided to support a small table to hold the control pack for the nintendo game or for playing any of the other television games or for any other purpose such as writing, reading, eating, etc., is provided to answer the often asked question, "If only I had another hand?" The device is provided with arcuately shaped concave holding areas to fit the inside of the operators legs of a person above the knees. The concave end supports are yieldingly connected to opposite ends of the small table in such a manner that a degree of lateral movement is provided between the supports and the table. With this small increment of spring action movement between the concave supports and the table there is little danger of the concave supports losing contact with the legs. It is thus apparent that by maintaining slight inward pressure between the legs and the concave supports the device will remain securely in place. The small table is thus securely held in place and is available for any use that a party wishes to make of it, including writing, reading, eating etc. Laterally shiftable auxiliary clamps are provided to clamp any desired objects to the surface of the table, and it will be realized that the hands are then free and are available to do whatever may be desired.

5 Claims, 2 Drawing Sheets

DEVICE FOR HOLDING ARTICLES

BACKGROUND OF THE INVENTION

While a number of attempts have been made to solve the problem of how to handle a situation where there are more than two things that need to be held or manipulated, no one has suceeded in solving the problem in a satisfactory manner. I have solved that problem by providing a device that can conveniently be held between the legs above the knees, and wherein a small table can be held at any desired angle between the leg clamps. Auxiliary laterally movable clamps on the table are provided to hold desired objects in a fixed location on the table top.

1. Field of the Invention

The field of invention as developed by applicant provides a small table which can be held between the legs above the kness. Spaced clamps slidably mounted on the small table are provided for lateral movement on the table to clamp any object to the table so that applicant's two hands are free to work on the object needing attention. In this way the article needing attention can be worked on in a more efficient manner.

2. Description of the Prior Art

Insofar as is known, no one prior to applicant has succeeded in providing a small table that can conveniently be held between the legs, and which has spaced clamps having contoured article engaging surfaces to contact and fasten the article on the table so that both of the operators hands are free to work on the article needing attention.

SUMMARY OF THE INVENTION

To solve the problem of having enough hands to hold various articles that need attention, and also having sufficient hands left over to do whatever work is needed on the article, I have solved the problem by providing a small table that can be held between the legs above the knees and wherein the table has readily movable and lockable clamps to hold the article needing attention. With this unique arrangement it is possible for one party to conveniently hold and perform whatever work is needed to achieve the desired results. In this way one person can perform the work that normally requires two or more people to perform.

DESCRIPTION OF THE PREFERRED EMBODIMENT

Figure 1:
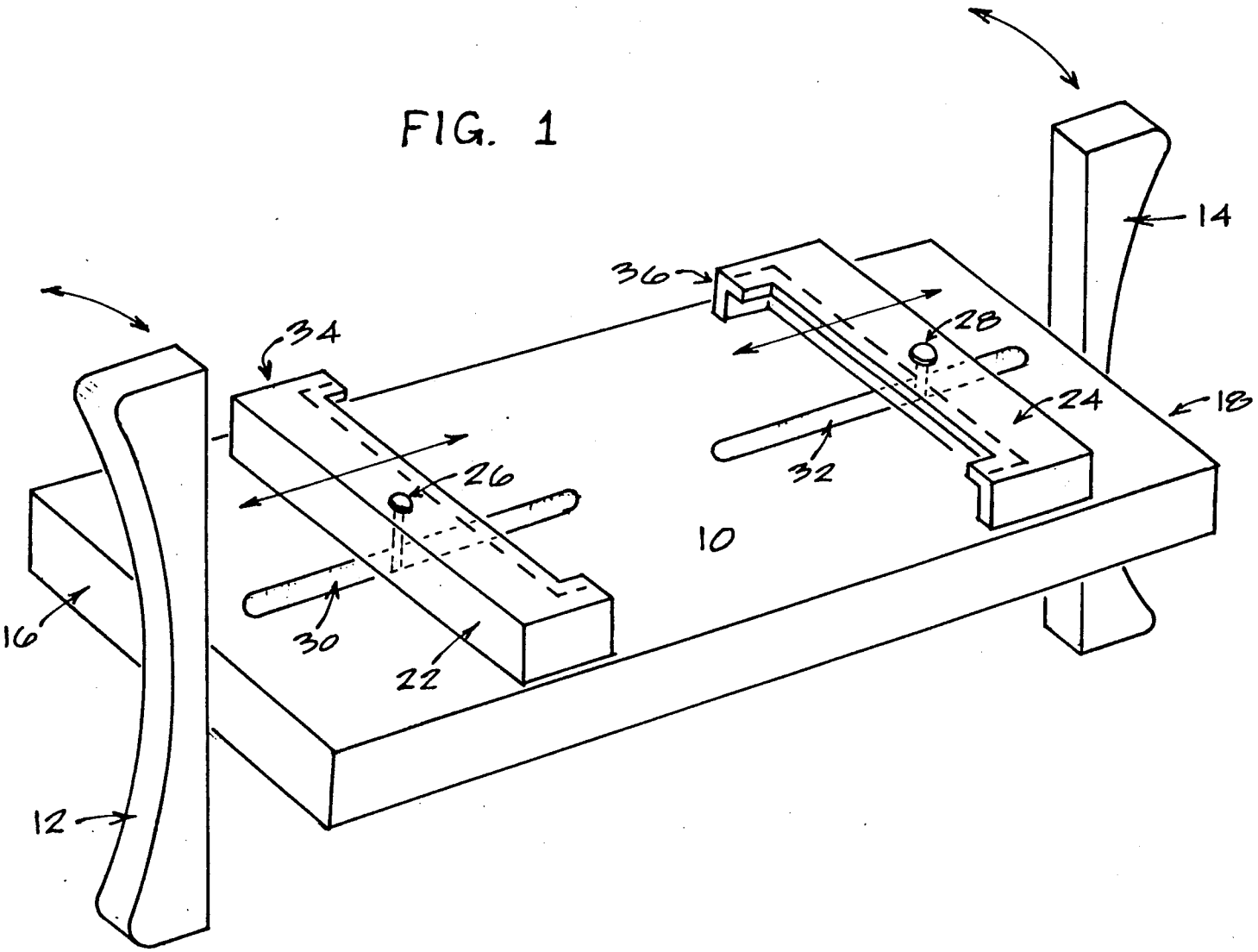
FIG. 1 is a perspective view showing a small table that can be held between the legs above the knees, and wherein article engaging clamps are employed to clamp various articles to the table.
Figure 2:
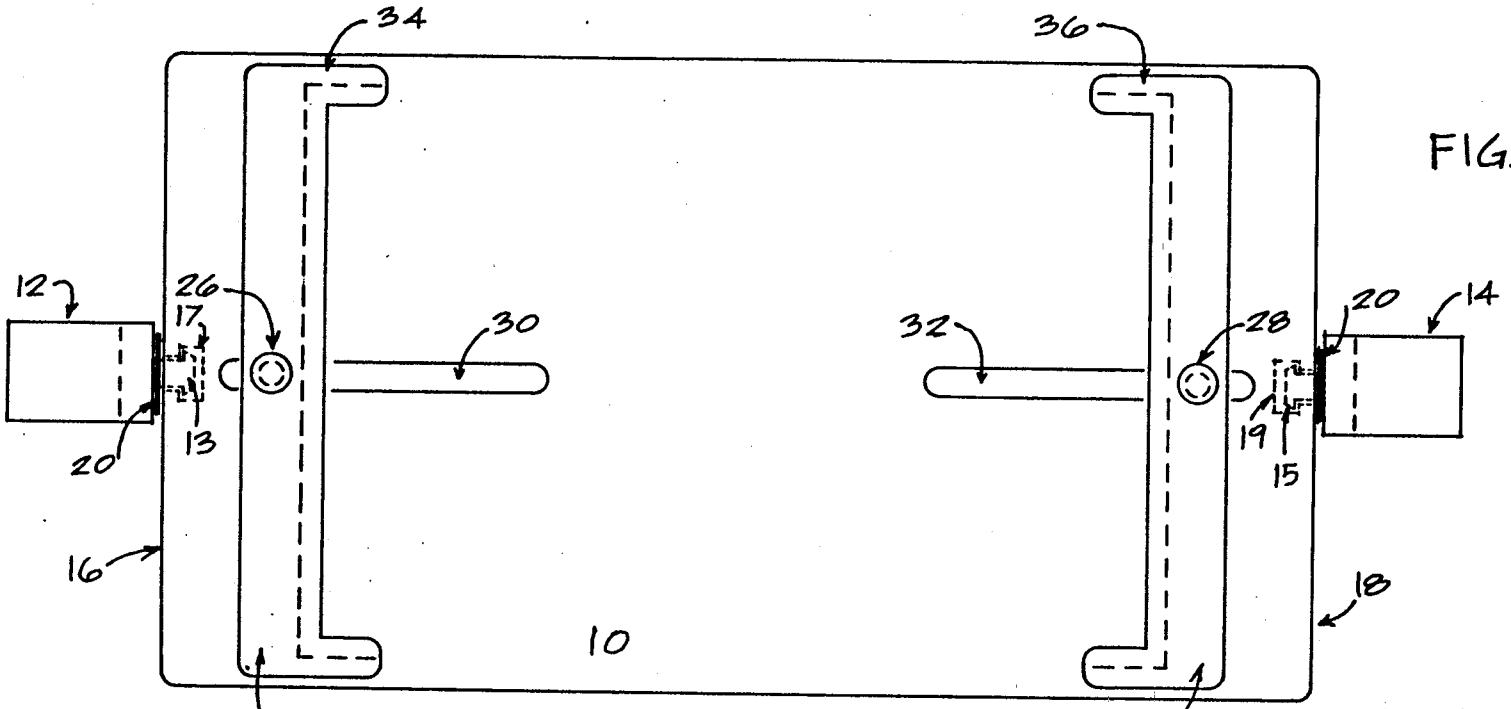
FIG. 2 is a top plan view of the device.

Referring now to the drawings, FIG. 1 illustrates my device for holding articles. A small rectangular table 10 has conical supporting elements 12 and 14 adapted to be positioned between a person's legs above the knees. The members 12 and 14 are pivotally mounted on a single pivot at the ends 16 and 18 of the table 10 so that the table can be moved angularly as desired. It will be noted that the arcuately shaped members 12 and 14 have central projections 13 and 15 having tapered and longitudinally slotted forward ends which can be contracted when forcefully projected into chambers 17 and 19 in the opposite ends 16 and 18 of the elongated table 10. The enlarged heads of the projections 13 and 15 are trapped behind reduced area shoulders of the chambers in the table and are thus yieldingly urged outwardly by springs 20 prevented from pulling out.

Since it is contemplated that this device will be used by children it is recognized that it is desirable that the arcuately shaped end pieces be locked in place so that they cannot be pulled out and lost.

The table 10 has a pair of top clamps 22 and 24 slidably mounted to move laterally towards and away from each other. The clamps 22 and 24 have bolts 26 and 28 movably mounted in slots 30 and 32 extending longitudinally in the table 10, and having wing nuts 38 and 40 whereby the clamps 22 and 24 can readily be secured to the table 10.

Figure 3:
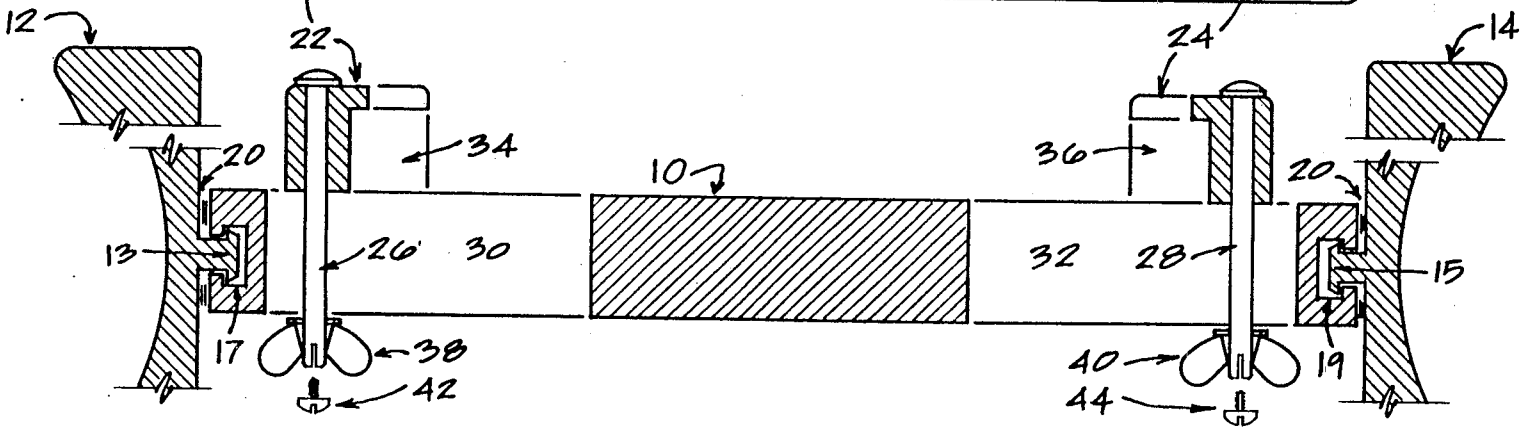
FIG. 3 is a side elevational view of the device.

In the interest of guarding against loss of parts by children or otherwise, locking screws 42 and 44 as illustrated in FIG. 3 may be provided to prevent the wing nuts 38 and 40 from being completely unthreaded and then being lost. The screws 42 and 44 thread into the shafts 26 and 28 and prevent the wing nuts from becoming completely unthreaded. If desired the locking nuts 42 and 44 can have screwdriver slots wherein the heads are cut away on one side to remove the angular sections so that the screws cannot be turned in the unscrewing direction.

In the operation of this type of equipment it is possible to perform any desired function such as the operation of a video game controller held between the clamps 22 and 24. The outer ends of the clamps 22 and 24 may have projections 34 and 36 which extend forwardly towards the center of the table 10 to assist in holding articles. Attention is directed to the fact that the table 10 is indeed a lap table, and can be used for any of the purposes for which a lap table can be used, including the eating of snacks or full course dinners thereon.

It will be apparent that if desired additional sets of clamps can be provided as needed to perform whatever work is to be performed. Clamps 22 and 24 will contact and hold any member that is of a size that it can be positioned on the table 10. The brackets 22 and 24 have horizontal members 34 and 36 parallel with the surface of the table 10.

I claim:

1. An element supporting device for an operator having legs with knees, an element supporting table having oppositely directed ends, oppositely directed concave members, and a pivotal connecting means pivotally connecting the oppositely directed ends of the table and the oppositely directed concave members along a single pivot axis in the plane of the table, said concave members positioned between the operator's legs above the knees and supported solely by the operator's legs to securely hold the element supporting table in a postion between the operator's legs.

2. The element supporting device defined in claim 1 wherein the oppositely directed concave members are movably mounted in opposite ends of the table in such a manner that a degree of longitudinal movement of the concave members is permitted but said members are prevented from separating from the table.

3. The element supporting device defined in claim 1 wherein an element is associated with the table, and longitudinally movable clamping means are provided to adjustably clamp said element to the table.

4. The element supporting device defined in claim 1 wherein an article is associated with the table, and clamps movably mounted on the table are provided to clamp the article to the table.

5. The element supporting device defined in claim 1 wherein an article is held to permit work to be done on the article, a pair of clamps slidably mounted in slots on the table, and means to actuate the clamps to hold the article to the table.

* * * * *